United States Patent [19]

Wanner et al.

[11] Patent Number: 5,059,257

[45] Date of Patent: Oct. 22, 1991

[54] HEAT TREATMENT OF PRECIPITATION HARDENABLE NICKEL AND NICKEL-IRON ALLOYS

[75] Inventors: Edward A. Wanner, Leesport; Sunil Widge, Dryville, both of Pa.

[73] Assignee: Carpenter Technology Corporation, Reading, Pa.

[21] Appl. No.: 364,795

[22] Filed: Jun. 9, 1989

[51] Int. Cl.[5] ..... C21D 8/00; C22F 1/10

[52] U.S. Cl. ..... 148/12.3; 148/12.7 R; 148/12.7 N; 148/142; 148/158; 148/162; 148/326; 148/328; 148/409; 148/410; 148/419

[58] Field of Search ..... 148/158, 162, 142, 12.3, 148/12.7 R, 12.7 N, 409, 410, 419, 326, 328

[56] References Cited

U.S. PATENT DOCUMENTS

| | | | |
|---|---|---|---|
| 2,570,194 | 10/1951 | Bieber | 148/410 |
| 3,048,485 | 8/1962 | Bieber | 420/582 |
| 3,705,827 | 12/1972 | Muzyka et al. | 420/447 |
| 3,871,928 | 3/1975 | Smith, Jr. et al. | 148/410 |
| 3,898,109 | 8/1975 | Shaw | 148/428 |
| 4,200,459 | 4/1980 | Smith, Jr. et al. | 420/447 |
| 4,445,943 | 5/1984 | Smith, Jr. et al. | 148/158 |
| 4,445,944 | 5/1984 | Smith, Jr. et al. | 148/158 |
| 4,487,743 | 12/1984 | Smith et al. | 420/459 |
| 4,624,716 | 11/1986 | Noel et al. | 148/162 |
| 4,685,978 | 8/1987 | Smith et al. | 148/162 |

*Primary Examiner*—R. Dean

*Attorney, Agent, or Firm*—Dann, Dorfman, Herrell and Skillman

[57] ABSTRACT

This invention provides a process for improving, to at least a predetermined level, the stress rupture life and/or stress rupture ductility of precipitation hardenable nickel and nickel-iron base alloys containing nickel, niobium, and silicon when said alloys have less than a predetermined level of these stress rupture properties when worked and aged by a primary heat treatment. This improvement in properties is accomplished by controlled precipitation of a sufficient quantity of a (Ni, Nb, Si)-containing intermetallic phase.

41 Claims, No Drawings

HEAT TREATMENT OF PRECIPITATION HARDENABLE NICKEL AND NICKEL-IRON ALLOYS

BACKGROUND OF THE INVENTION

This invention relates to a process for heat treating precipitation hardenable nickel and nickel-iron base alloys, particularly for improving the stress rupture properties of such alloys at temperatures of about 1200F (about 650C.) while providing adequate tensile strength.

Precipitation hardenable nickel and nickel-iron base alloys fulfill a variety of industrial and commercial demands. For instance, some parts are required to fit to close tolerances despite being subjected to repeated temperature cycling to elevated temperatures, i.e., rings and seals manufactured for gas turbine and aircraft jet engines. Certain precipitation hardenable nickel-iron base alloys possess low thermal expansion characteristics and thus may be advantageously used to satisfy such requirements.

Articles made from precipitation hardenable nickel and nickel-iron base alloys may be shaped using a wide variety of practices including machining and hot, warm, and cold forming but are often manufactured by hot working. Typically, in hot working, the workpiece is first forged. The forging is then either heat treated or subjected to additional hot working operations, such as hot fabrication or welding, before being heat treated. An example of hot fabrication is the forming of turbine rings by ring rolling, a technique wherein a billet of an alloy is upset hot, a hole is punched out of the middle to form a torus, and then the hollow billet is hot rolled between internal and external working rolls to the desired shape. Another ring forming hot fabrication method is flash butt welding, wherein a bar of an alloy is bent cold into the form of a ring, and the adjacent ends of the bar are then flash welded, that is, an electric current, sufficient to create a zone of molten metal, is passed across the adjoining surfaces of the two ends while the two ends are forced together with pressure sufficient to expel substantially all of the molten metal out of the weld zone, resulting in essentially a solid state weld.

The finished or partially finished article is usually solution treated and aged. Solution treatment is necessary to relieve undesirable residual stress and strain, and in order to put the article into a state satisfactory for subsequent aging. Aging is necessary to impart the mechanical properties required of the article for service at subambient, ambient, and/or elevated temperatures.

There are known heat treatments for precipitation hardenable nickel and nickel-iron base alloys. For example, U.S. Pat. No. 2,570,194, issued to C.G. Bieber et al. on Oct. 9, 1951, is directed to providing improved high temperature creep properties by including in the alloy controlled amounts of chromium, aluminum, titanium, niobium, and zirconium and subjecting the alloy to a heat treatment which includes an intermediate step between a solution treating step and an aging step. This intermediate step calls for heating at 1500–1800F. (about 815–980C.) for 1/2–24 h.

U.S. Pat. No. 3,048,485, issued to C.G. Bieber on Aug. 7, 1962, relates to an alloy containing 25–50 w/o nickel, 8–25 w/o chromium, 1.5–6 w/o titanium, 2–8 w/o molybdenum, 0.01–0.3 w/o boron, and the balance iron plus optional amounts of manganese, silicon, vanadium, tungsten, and copper. The high temperature properties of the alloy are to be developed by a heat treatment which usually includes solution treatment at 1800–2150F. (about 980–1175C.) followed by one or more aging treatments between 1100–1500F. (about 595–815C.). An intermediate or pre-aging treatment between 1500–1750F. (about 815–955C) is mentioned as optional.

U.S. Pat. No. 3,705,827, issued to D.R. Muzyka et al. on Dec. 12, 1972, relates to nickel-iron base alloys, with or without chromium and cobalt, containing niobium, titanium, and aluminum and a heat treatment therefor for bringing out intragranular gamma prime and gamma double prime phases ($Ni_3$ (Nb,Ti,Al)). These phases have a lower solvus temperature than eta phase ($Ni_3Ti$) and delta phase ($Ni_3Nb$) formed at the grain boundaries. The use of an 1800F. (about 980C.) solution treatment followed by stabilization at 1650F (about 900C.) (as specified in U.S. Pat. No. 3,048,485) is described as adversely affecting stress rupture life (Col. 7).

U.S. Pat. No. 3,871,928, issued to D.F. Smith, Jr. et al. on March 18, 1975, relates to the heat treatment of nickel alloys containing at least 2 w/o (Nb +Ti), at least 25 w/o Ni, and up to 60 w/o Fe with %Ni +%Fe $\geqq$50 w/o in which various optional elements including 8 w/o or more Cr may be present. Heat treatment includes solution treating between 1600–1950F. (about 870–1065C.), controlled cooling down to 11OOF. (about 595C.), and aging between 1100–1625F. (about 595–885C.). A triple stage heat treatment is recited for a nickel-iron-chromium alloy calling for solutioning at 1750F. (about 955C.) or above, slow cooling to below the precipitation hardening range to 11OOF. (about 595C.) followed by cooling in air to room temperature, then reheating to 1450–1625F. (about 790–885C.) for about 1 to 24 h, again cooling to room temperature, then aging between 1275–1425F. (about 690–775C.) for 1 to 24 h, cooling to 1100–1200° F. (about 595–650C) and holding for 5 to 24 h, and then cooling to room temperature.

U.S. Pat. No. 3,898,109, issued to S.W.K. Shaw on Aug. 5, 1975, relates to a four stage heat treatment for nickel-chromium-cobalt base alloys which interposes between solutioning and aging steps two intermediate steps, one at 1775–1890F. (about 970–1030C.) and the other at 1600–1700F. (about 870–925C.). Shaw points out the difficulty encountered in enhancing both stress rupture strength and ductility at an elevated temperature level of about 816C (about 1500F) and that two prior art four-stage treatments for nickel-chromium-cobalt base alloy seriously impair either stress rupture life or ductility at 1500F (about 816C.).

U.S. Pat. Nos. 4,445,943 and 4,445,944, both issued to D.F. Smith, Jr. et al. on May 1, 1984, are directed to similar overaging heat treatments applicable to certain low thermal expansion alloys. These treatments are reported to give overaged structures which contribute to high notch strength at temperatures of about 1000F. (about 540C), but with a reduction in tensile strength and ductility. The alloys differ primarily in that up to 5 w/o cobalt is optional in the '943 patent and 5–25 w/o cobalt is present in the '944 patent. Each calls for overaging by heating in an intermediate temperature range, 1425–1550F. (about 775–845C.) for '943 and 1375–1550 F. (about 745–845C) for '944.

U.S. Pat. No. 4,624,716, issued to Noel et al. on Nov. 25, 1986, describes a method for heat treating a nickel base superalloy, which method is reported to improve stress rupture life by controlling carbide precipitation on grain boundaries while promoting intragranular formation of gamma prime particles and carbides.

U.S. Pat. No. 4,200,459, issued to D.F. Smith, Jr. et al. on Apr. 29, 1980, and U.S. Pat. No. 4,487,743, issued to D.F. Smith et al. on Dec. 11, 1984, both describe low thermal expansion, precipitation hardenable, nickel-iron base alloys and heat treatments therefor. U.S. Pat. No. 4,685,978, issued to Smith et al. on Aug. 11, 1987, also describes a heat treatment for a low thermal expansion, precipitation hardenable, nickel-iron base alloy. All three patents report improvements in stress rupture properties by use of primary heat treatments which all consist of solution treatment followed by multi-step aging treatments. Additionally, the 1459 patent reports an optional intermediate step at 1350–1550F. (about 730–845C.).

A significant problem in the manufacture of articles made from precipitation hardenable nickel and nickel-iron base alloys is that after working and heat treatment by methods known in the art, each of which heat treatments is termed a primary heat treatment in this application, a substantial quantity of articles or workpieces fail to exhibit the required quantum of stress rupture ductility and/or life. A related problem occurs when a test specimen representative of a batch of workpieces is subjected to a primary heat treatment and fails to exhibit the required stress rupture properties. The rest of the batch is then considered to be of unacceptable quality and thus unsuitable for primary heat treatment. In both cases, such articles are considered unsatisfactory and heretofore have only been considered useful as scrap or for reworking.

SUMMARY OF THE INVENTION

It is, therefore, a principal object of this invention to provide a heat treatment for precipitation hardenable nickel and nickel-iron base alloys, especially for low thermal expansion, essentially chromium-free alloys, which when worked and then heat treated by a primary heat treatment would have less than the required stress rupture properties.

This invention is based on the discovery that, when primary heat treatments, with or without heating at a temperature intermediate annealing or solution treatment on the one hand and aging on the other, cannot be successfully used to obtain certain required properties in precipitation hardenable nickel and nickel-iron base alloys, such required properties are attainable by a process comprising a pre-aging heat treatment which provides an effective amount of a (Ni, Nb, Si)-containing intermetallic phase in such an alloy whereby the stress rupture ductility and/or the stress rupture life properties of the as-aged alloy are improved while maintaining required tensile strength.

Our research concerning the heat treatment of a precipitation hardenable, low thermal expansion nickel-iron base alloy has been focused on the controlled precipitation of a (Ni, Nb, Si)-containing intermetallic phase by a pre-aging heat treatment of the alloy for an adequate time at certain temperatures before aging the alloy. The conditions under which the pre-aging step is carried out affect the quantity of the intermetallic phase that precipitates and the stress rupture characteristics exhibited by the alloy. Significant improvements in the stress rupture life and/or stress rupture ductility of the alloy, while maintaining satisfactory tensile properties, have been provided when the primary heat treatment has proven ineffective in providing the desired stress rupture characteristics.

In the preferred embodiment of the present invention the alloy and products formed therefrom are heat treated by annealing or solution treating at a temperature and for a time sufficient to dissolve the major portion of, and in most instances preferably substantially all of, the precipitated intermetallic phases that may be present in said alloy except that, preferably, the solutioning of any desired (Ni, Nb, Si)-containing intermetallic phase present in said alloy is minimized; pre-aging at a temperature and for a time sufficient to form the (Ni, Nb, Si)-containing intermetallic phase in a quantity sufficient to improve the stress rupture life and/or stress rupture ductility of said alloy to at least the desired level when aged; and aging at a temperature and for a time sufficient to precipitate a strengthening phase within said alloy. The heat treatment of this invention is intended for use with a wide variety of nickel and nickel-iron base alloys.

DETAILED DESCRIPTION OF THE INVENTION

The invention is directed to a heat treatment for precipitation hardenable nickel and nickel-iron base alloys, containing nickel, niobium, and silicon for forming a (Ni, Nb, Si)-containing intermetallic phase, which do not respond properly when subjected to primary heat treatments. To that end, the alloys advantageously contain about 25–55 w/o nickel, 1.5–7 w/o niobium, and from at least a small but effective amount to about 1 w/o silicon. More specifically, the process of the present invention is applicable to a class of precipitation hardenable nickel and nickel-iron base alloys having the approximate analysis, in weight percent (w/o), summarized in Table I:

TABLE I

| | w/o | | |
|---|---|---|---|
| | Broad | Intermediate | Preferred |
| C | 0–0.1 | 0–0.1 | 0–0.1 |
| Mn | 0–2 | 0–1 | 0–0.5 |
| Si | (a) | (a) | (a) |
| Cr | 0–25 | 0–1 | 0–0.5 |
| Mo | 0–10 | 0–1 | 0–0.5 |
| Ni | 25–65 | 25–55 | 25–45 |
| Co | 0–25 | 0–25 | 5–20 |
| Ti | 0.5–4 | 1–3 | 1–2.5 |
| Nb | 1.5–7 | 1.5–7 | 3–7 |
| Al | 0–2 | 0–2 | 0–0.2 |
| V | 0–1 | 0–0.5 | 0–0.5 |
| B | 0–0.03 | 0–0.03 | 0–0.02 |
| Zr | 0–0.1 | 0–0.1 | 0–0.01 |
| Hf | 0–2 | 0–2 | 0–0.1 |
| W | 0–3 | 0–0.5 | 0–0.5 |

(a)-from at least a small but effective amount to about 1 w/o

For all stated ranges, the balance of the alloy is essentially Fe, and preferably at least 2 w/o Fe, except for incidental impurities and additions which do not detract from the desired properties. For example, up to about 0.015 w/o of each of the elements phosphorus and sulfur, up to about 0.01 w/o of each of the elements calcium and magnesium, and up to about 0.5 w/o copper are tolerable in the alloy. In all cases zirconium is considered an incidental impurity.

Further, the process of the present invention is applicable to compositions within the preferred range having about 32–45 w/o Ni, and better yet about 32–40 w/o Ni. The present process is also applicable to compositions within the preferred range having about 10–20 w/o Co, as well as to those compositions having about 0.1–0.7 w/o Si, and better yet having about 0.2–0.7 w/o Si. Also, the present invention is applicable to the more preferred range consisting essentially of, in weight percent, about 0–0.1 C, 0–0.5 Mn, 0.2–0.7 Si, 0–0.5 Cr, 0–0.5 Mo, 32–40 Ni, 10–20 Co, 1–2.5 Ti, 3–7 Nb, 0–0.2 Al, 0–0.5 Y, 0–0.02 B, 0–0.01 Zr, 0–0.1 Hf, 0–0.5 W.

Some small amount of silicon is necessary in each alloy. Although the interaction of the composition of the alloy on the one hand and the present heat treatment on the other in improving the properties over those attainable by a primary heat treatment is not fully known or understood, it has been determined that the presence of silicon is important to the formation of the (Ni, Nb, Si)-containing intermetallic phase. Silicon and niobium co-act in the formation of the intermetallic phase. Although this relationship has not been fully characterized, it has been found that, in general, when lesser amounts of silicon are present in the alloy, greater amounts of niobium are usually necessary to attain the desired extent of intermetallic phase formation. In alloys containing lesser amounts of niobium, formation of this phase can be facilitated by using greater amounts of silicon within the stated ranges. It has also been found that the presence of high electron vacancy elements including Cr, Mo, v, W, or Fe can facilitate formation of this phase. Throughout this specification and the appended claims, when the element niobium is referred to, it is to be understood as including that amount of tantalum usually present in commercial supplies of niobium customarily used for alloying purposes. Further, additional amounts of niobium can be replaced if desired by equivalent amounts of tantalum. Thus "niobium" is to be read as including tantalum or as the combined niobium plus tantalum content of the composition.

The foregoing tabulation is provided as a convenient summary and is not intended thereby to restrict the lower and upper values of the ranges of the individual elements of the alloy of this invention for use solely in combination with each other or to restrict the broad, intermediate, preferred, or more preferred ranges of the elements for use solely in combination with each other. Thus, one or more of the broad, intermediate, preferred and more preferred ranges can be used with one or more of the other ranges for the remaining elements. In addition, a broad, intermediate, preferred, or more preferred minimum or maximum for an element can be used with the maximum or minimum for that element from one of the remaining ranges. Throughout this application, unless otherwise indicated, all compositions in percent will be in percent by weight (w/o).

In the preferred embodiment of the present invention, heat treatment of the alloy is carried out by solution treating said alloy at a temperature and for a time sufficient to dissolve the major portion of, and in most instances preferably substantially all of, the precipitated intermetallic phases present in said alloy except that, preferably, solutioning of any desired (Ni, Nb, Si)-containing phase present in said alloy is minimized; followed or preceded by a pre-aging treatment at a temperature and for a time sufficient to form the (Ni, Nb, Si)-containing intermetallic phase in a quantity sufficient to improve the stress rupture life and/or stress rupture ductility of the alloy in the as-aged condition to at least the desired level; and aging at a temperature and for a time sufficient to precipitate a strengthening phase within said alloy. The solution treating step may be performed before or after the pre-aging step.

The solution treatment of the present process is carried out at a temperature and for a time sufficient to dissolve the major portion of, and in most instances preferably substantially all of, the precipitated intermetallic phases present in said alloy except that, preferably, the solutioning of any desired (Ni, Nb, Si)-containing phase present in said alloy is minimized. More specifically, the phases to be solutioned include such precipitated intermetallic phases as the known gamma prime, gamma double prime, eta, and/or delta phases which, depending upon the alloy composition, may be present as a result of prior processing, that is, prior working, cooling therefrom, and/or unsuccessful heat treatment of the alloy. on the other hand, solutioning of any desired (Ni, Nb, Si)-containing intermetallic phase present as a result of prior processing is preferably minimized, the phase being preferably retained to enhance the stress rupture properties of the as-aged alloy.

It is well known that solution treatment temperatures can be determined by known survey methods. In selecting appropriate solution treating temperatures for a given alloy composition, advantage may be taken of the fact that the desired (Ni, Nb, Si)-containing intermetallic phase has a higher solvus temperature than those corresponding to the precipitated intermetallic phases to be solutioned. Thus, depending on alloy composition, solution treating temperatures may be selected such that precipitated intermetallic phases, such as gamma prime, gamma double prime, eta, and/or delta phases, are solutioned while preferably the (Ni, Nb, Si)-containing intermetallic phase is not solutioned. In certain instances, it is desirable that at least one of the phases usually solutioned be retained in precipitated form during and after solution treatment. For example, in certain low thermal expansion alloys to which this invention is applicable it is desirable that eta phase not be solutioned in order to promote fine grain structure in the alloy. In such case, the solution treating temperature would be kept below the solvus temperature of that phase. Also, in some instances, it is desirable to keep the solution treating temperature below the recrystalization temperature of the alloy. Suitable solution treating temperatures for the ranges of Table I extend over a broad band of temperatures, e.g., about 1500–2100F. (815–1150C.). As is also well known, the duration of such treatments depends upon the thickness of the material and the rates of dissolution of the various intermetallic phases. For specific compositions, suitable solution treating temperatures will be readily determined by those skilled in such matters as was noted herein before. More specifically, it may be noted that the intermediate, preferred, and more preferred ranges fall within narrower temperature bands, about 1500–2000F. (about 815–1095C.) for the intermediate range and about 1800–2000F. (about 980–1095C.) for both the preferred and more preferred ranges, while the optimum solution treating temperature for any given composition is readily determined by well known procedures.

Following solution treatment, the alloy is preferably allowed to air cool to ambient temperature before proceeding to the next step in the process.

The pre-aging heat treatment of the present invention results in the precipitation of the (Ni, Nb, Si)-containing intermetallic phase, the presence of which benefits the stress rupture properties, particularly the stress rupture ductility, of the alloy. More particularly, the pre-aging step results in the inter- and/or intragranular precipitation of the (Ni, Nb, Si)-containing intermetallic phase as globular-shaped particles with a major diameter of 0.1–2μm. Here and throughout this application, the term "globular" means a shape which is irregularly rounded and does not include sharp angles. The term "globular" is intended to encompass, but is not limited to, ellipsoids, oblate or prolate spheroids, tear-drop shapes, and pear shapes as well as combinations thereof. The solution treating step generally precedes the pre-aging step, however, if solution treatment temperatures are maintained below a certain level, the pre-aging step can be carried out prior to solution treatment. Regardless of whether the pre-aging step is conducted prior to or subsequent to solution treatment, the (Ni, Nb, Si)-containing intermetallic phase particles are substantially uniformly dispersed in the austenitic matrix. When the solution treating step precedes the pre-aging step, precipitation of the (Ni, Nb, Si)-containing intermetallic phase also occurs on recrystallized grain boundaries.

The pre-aging step of the present invention is carried out at a temperature and for a time sufficient to form the (Ni, Nb, Si)-containing intermetallic phase in a quantity sufficient to improve the stress rupture life and/or stress rupture ductility of the alloy to at least a predetermined level when aged. Preferably, the pre-aging step is carried out at a temperature and for a time sufficient to form at least 0.25 volume percent of the (Ni, Nb, Si)-containing intermetallic phase. For a given alloy the intermetallic phase has a higher solvus temperature than those corresponding to the other phases which may be present, namely gamma prime, gamma double prime, delta, and/or eta, thus allowing the pre-aging step to be conducted at a temperature low enough to favor precipitation of the (Ni, Nb, Si)-containing intermetallic phase but high enough to minimize the precipitation of the other phases.

The pre-aging temperature is a function of the composition of an alloy; for instance, the solvus temperature of the (Ni, Nb, Si)-containing intermetallic phase has been found to increase with increasing niobium content. Therefore, a survey must be conducted to determine the optimal pre-aging temperature range for a given alloy. Given an alloy of known composition, such a survey can be conducted in the manner outlined below. The methods and equipment utilized are well known. Firstly, a suitable temperature range for study must be postulated. It will be recognized that a number of factors will influence this determination. Whenever possible known pre-aging temperature ranges of analogous alloys should be considered. Next, solution treated alloy samples with a processing history equivalent to that expected for actual articles are obtained and temperatures are chosen in approximately 50F° (about 28C° ) intervals throughout the study range. In particular, the alloy samples chosen should have imparted thereto stress and strain characteristics similar to those that would be in the actual articles at the time the articles would be pre-aged. An alloy sample is treated for about 8 h at each chosen temperature. Next, longitudinal metallographic coupons of each pre-aged sample are taken, and each such specimen is optically examined to determine the amount of (Ni, Nb, Si)-containing intermetallic phase precipitation at a given temperature. The results from all specimens are compared and a pre-aging temperature range which encompasses those temperatures which give optimal property-enhancing precipitation of the desired (Ni, Nb, Si)-containing intermetallic phase is chosen.

When, as is the more frequent case, the solution treating step precedes the pre-aging step, the pre-aging can be carried out over a broad temperature range, about 1500–1900F. (about 815–1040C.) for the broad range of compositions and at about 1500–1850F. (about 815–10-10C.) and about 1650–1850F. (about 900–1010C.) for alloy compositions falling within the intermediate and preferred ranges respectively. For compositions falling within the more preferred range hereinbefore described, the pre-aging step is carried out at about 1675–1850F. (about 915–1010C.). When the pre-aging step is carried out before the solution treating step, the solution treating step is carried out at a temperature and for a time such that at least 0.25 volume percent of the (Ni, Nb, Si)- containing intermetallic phase remains undissolved after the solution treating step is completed. For alloy compositions falling within the more preferred range hereinbefore described, the solution treating step is carried out at or below about 1850F. (about 1010C.), and preferably at about 1800F. (about 980C.), when this step follows the pre-aging step. When the pre-aging step is completed, the alloy is preferably air cooled to ambient temperature before proceeding to the next step of the invention.

The aging treatment of the present invention establishes the room and elevated temperature tensile strength of the alloy by heating the alloy at a temperature and for a time sufficient to precipitate a strengthening phase. In most alloys to which the present invention applies, the primary strengthening phase precipitated during aging is gamma prime. In the other alloys, another phase, such as gamma double prime, is the primary strengthening phase. It is well known that aging temperatures are a function of alloy composition and may be determined by known survey methods. Aging is preferably conducted using a two-step cycle. For alloy compositions falling within the broad, intermediate, or preferred ranges listed in Table I, the first aging step is carried out within the temperature range of about 1200–1500F. (about 650–815C.) for at least 4–12 h to precipitate the strengthening phase. For alloy compositions falling within the more preferred range hereinbefore described, the first aging step is carried out within the temperature range of about 1275–1475F. (about 690–800C.), for at least 4–12 h and is preferably carried out at 1325F. (about 720C.) for 4–12 h when the solution treating temperature is about 1800F. (about 980C.), and preferably at about 1425F. (775C.) for at least 4-12 h when a solution treating temperature of about 1900F. (about 1040C.) is utilized. The alloy is then cooled, preferably in a controlled manner by furnace cooling at a rate of about 100F.° /h (about 56C.° /h) to the temperature of the second aging step.

The second aging step causes the further precipitation of the strengthening phase particles. For all alloys to which the present invention applies, this step may be carried out in the temperature range of about 1100–1200F. (595–650C.) for at least 4 h, however, it is preferably carried out at about 1150F. (about 620C.) for at least 4 h. Lastly, the alloy is allowed to air cool to ambient temperature.

The present invention lends itself to use in the fabrication of a wide variety of articles. Articles of manufacture which can be heat treated by the process disclosed in this application, either during or after fabrication, include parts for aerospace engines such as rings, spacers, engine casings, ducting, diffusers and engine structural members. An additional contemplated use for such articles is in space vehicle engines where contact with high pressure hydrogen is required. Articles heat treated by the process of the present invention are also useful in the extrusion of copper and its alloys, namely, articles such as extrusion die blocks, extrusion dummy blocks, and extrusion liners.

Articles made in accordance with the present invention are comprised of at least 0.25 volume percent of particles of the (Ni, Nb, Si)-containing intermetallic phase which are globular in shape and 0.1–2μm in major diameter. These particles are substantially uniformly distributed throughout the austenitic metallic matrix of the article, and in some cases are also found on recrystalized grain boundaries within the article.

EXAMPLES

Set forth below are examples which illustrate the useful and beneficial effects of the process of the present invention. Good results were obtained when the preferred embodiment of the present invention was applied to two compositions of a precipitation hardenable, essentially chromium-free, low thermal expansion alloy falling within the more preferred range hereinbefore described. Examples 1–9 and A–H were all taken from Heat No. 555, the composition of which is shown in Table II. Examples 10–13 and I–L were taken from Heat No. 033, the composition of which is also shown in Table II.

TABLE II

| | w/o | |
|---|---|---|
| | Heat No. 555* | Heat No. 033** |
| C | 0.023 | 0.021 |
| Mn | 0.02 | 0.08 |
| Si | 0.39 | 0.42 |
| Cr | 0.08 | 0.20 |
| Mo | 0.07 | 0.13 |
| Ni | 38.40 | 38.40 |
| Co | 13.62 | 13.48 |
| Ti | 1.59 | 1.58 |
| Nb | 4.76 | 5.07 |
| Al | 0.12 | 0.037 |
| Ta | <0.02 | — |
| B | 0.008 | 0.0068 |
| Cu | 0.03 | — |
| P | 0.003 | 0.005 |
| S | 0.001 | 0.001 |
| Fe | Balance | Balance |

*Ex. 1–9 and A–H in Tables III and IV.
**Ex. 10–13 and I–L in Tables III and IV.

Both heats were melted in a vacuum induction furnace and cast into 17 in (about 43 cm) diameter electrodes which were refined by vacuum arc remelting into 20 in (about 51 cm) diameter ingots. The ingots were homogenized and then forged to 8 in (about 20 cm) diameter billets from which forgings of several shapes were fabricated. A laboratory pilot bar (Exs. A, 1, B, 2, and 3 in Tables III and IY) was forged from a 3 in ×3 in (about 7.5 cm ×7.5 cm) transverse oriented billet slice to a 1.5 in ×1.5 in (3.8 cm ×3.8 cm) bar from a soak temperature of 1700F (about 925C). Ring No. 1 (Exs. C, 4, F, and 7 in Tables III and IY) was forged to 12-⅜ in o.d. ×7-⅞ in i.d. x 2-β in (about 31.4 cm o.d. x 18.7 cm i.d. x 7.3 cm). Ring No. 2 (Exs. D, 5, G, and 8 in Tables III and IY) was forged 15-⅛ in o.d. x 10-¾ in i.d. x 2-⅞ in (about 38.4 cm o.d ×27.3 cm i.d. ×7.3 cm). The pancake (Exs. E, 6, H, and 9 in Tables III and Iv) was upset forged to 12-½ in diameter x 2-½ in (about 31.8 cm diameter ×6.4 cm). Ring No. 3 (Exs. I, 10, J, and 11 in Tables III and IY) was forged to 16-¼ in o.d. x 13 in i.d. x 13-¾ in (about 41.3 cm o.d. ×33.0 cm o.d. ×34.9 cm) as was Ring No. 4 (Exs. K, 12, L, and 13 in Tables III and IY). The laboratory pilot bar, Ring No. 2, and Ring No. 4 were forged, using an optimum forging practice to generate fine grain structure, for comparison with the upset pancake, Ring No. 1 and Ring No. 3 which were forged using a non-optimum forging practice to generate a non-optimum grain structure in order to study the effect of the present process on products of such a non-optimum forging practice.

Test specimens were rough-cut from each forging and heat treated. The specimens were cut such that their longitudinal axis was oriented approximately along the direction of metal flow in the forging, that is, along the longitudinal axis of the laboratory pilot bar, tangentially in the rings, and radially in the upset pancake. In general, when heat treating alloys, including the test specimens, whose composition falls within the more preferred range herein before described, solution treatment is carried out at about 1800–2000F. (about 980–1095C.) for a time depending upon the thickness; the favored temperature range is about 1800–1900F. (about 980–1040C.) and the preferred solution treating temperature is about 1800F. (about 980C.). It is an advantage of the present process that the improved properties are obtained even when the alloy and articles made therefrom are solution treated or subjected during fabrication to temperatures as high as about 1900F. (about 1040C.). When, as is the more frequent case, the solution treating step precedes the pre-aging step, the pre-aging step is carried out at range of about 1675–1850F. (about 915–1010C.). The temperature range of about 1675–1750F. (about 915–955C.)is favored and preferably this step is carried out at about 1725F. (about 940C.). When the pre-aging step is carried out before the solution treating step, the solution treating step is carried out at or below about 1850F. (about 1010C.), and preferably at about 1800F. (about 980C.). The first aging step is carried out within the temperature range of about 1275–1475F. (about 690–800C.), for at least 4–12 h and is preferably carried out at 1325F. (about 720C.) for 4–12 h when the solution treating temperature is about 1800F. (about 980C.), and preferably at about 1425F. (775C.) for at least 4–12 h when a solution treating temperature of about 1900F. (about 1040C.) is utilized. The second aging step may be carried out in the temperature range of about 1100–1200F. (595–650 C.) for at least 4 h, however, it is preferably carried out at about 1150F. (about 620C.) for at least 4 h. The heat treatment of each specimen is detailed in Tables III and Iv. The heat treatment of the numbered examples included the pre-aging step in accordance with the present invention; each lettered example was solution treated and aged under the same conditions as the corresponding numbered examples according to known primary heat treatments, but was not subjected to the pre-aging treatment. After heat treatment standard A.S.T.M. subsize smooth (0.252 in (about 0.640 cm) gage diameter) tensile test specimens and combination smooth/notch stress rupture test specimens (0.178 in (about 0.452 cm) gage dia./0.178 in (about 0.452 cm) notch dia., $K_t=3.7$) were prepared.

Results from duplicate room temperature and elevated temperature (1200F/about 650C) tensile tests are shown in Table III, including 0.2% offset yield strength (0.2% Y.S.) and ultimate tensile strength (U.T.S.), both given in thousands of pounds per square inch (ksi) and in megapascals (MPa), as well as the percent elongation (% El.) and the percent reduction in cross-sectional area (% R.A.). Stress rupture testing was carried out on duplicate test specimens at 1200F. (about 650C.) by applying a constant load to generate an initial stress of 74 ksi (about 510 MPa). The results of the stress rupture tests are shown in the Table Iv including time to failure (Rupt. Life) in hours (h), the percent elongation (% El.), and the percent reduction in cross-sectional area (% R.A.).

The minimum required stress rupture property levels were predetermined to be 4.0% elongation for stress rupture ductility and 23h for stress rupture life.

| Ex. | Forging Shape | $T_S$ F.(C.) | $T_P$ F.(C.) | $T_A$ F.(C.) | R.T. Tensile ksi (MPa) 0.2% Y.S. | U.T.S. |
|---|---|---|---|---|---|---|
| A | Bar | 1900(1040) | None | 1425(775) | 131.7(908.0) | 175.1(1207.3) |
| | | | | | 134.9(930.1) | 176.6(1217.6) |
| 1 | " | 1900(1040) | 1725(940) | 1425(775) | 126.7(873.6) | 171.7(1183.8) |
| | | | | | 129.3(891.5) | 173.1(1193.5) |
| B | " | 1800(980) | None | 1325(720) | 156.1(1076.3) | 197.0(1358.3) |
| | | | | | 155.1(1069.4) | 193.4(1333.4) |
| 2 | " | 1800(980) | 1725(940) | 1325(720) | 154.6(1065.9) | 193.6(1334.8) |
| | | | | | 155.0(1068.7) | 194.3(1339.7) |
| 3 | " | 1800*(980) | 1725*(940) | 1325(720) | 155.7(1073.5) | 196.4(1354.1) |
| | | | | | 158.1(1090.1) | 195.8(1350.0) |
| C | Ring #1 | 1900(1040) | None | 1425(775) | 131.0(903.2) | 175.0(1206.6) |
| 4 | " | 1900(1040) | 1725(940) | 1425(775) | NOT TESTED | |
| D | Ring #2 | 1900(1040) | None | 1425(775) | 131.8(908.7) | 176.8(1219.0) |
| | | | | | 132.5(913.6) | 176.4(1216.2) |
| 5 | " | 1900(1040) | 1725(940) | 1425(775) | 128.7(887.4) | 174.7(1204.5 |
| | | | | | 127.2(877.0) | 173.7(1197.6) |
| E | Pancake | 1900(1040) | None | 1425(775) | 133.9(923.2) | 174.5(1203.1) |
| | | | | | 136.0(937.17) | 175.3(1208.7) |
| 6 | " | 1900(1040) | 1725(940) | 1425(775) | 129.7(894.2) | 170.1(1172.8) |
| | | | | | 130.4(899.1) | 172.7(1190.7) |
| F | Ring #1 | 1800(980) | None | 1325(720) | 167.0(1151.4) | 201.0(1385.8) |
| 7 | " | 1800(980) | 1725(940) | 1325(720) | NOT TESTED | |
| G | Ring #2 | 1800(980) | None | 1325(720) | 161.8(1115.6) | 199.0(1372.1) |
| | | | | | 165.2(1139.0) | 200.7(1383.8) |
| 8 | " | 1800(980) | 1725(940) | 1325(720) | 152.8(1053.5) | 189.0(1303.1) |
| | | | | | 150.6(1038.4) | 188.7(1301.0) |
| H | Pancake | 1800(980) | None | 1325(720) | 160.0(1103.2) | 193.5(1334.1) |
| | | | | | 159.0(1096.3) | 190.7(1314.8) |
| 9 | " | 1800(980) | 1725(940) | 1325(720) | 153.3(1057.0) | 189.8(1308.6) |
| | | | | | 149.3(1029.4) | 187.7(1294.1) |
| I | Ring #3 | 1900(1040) | None | 1425(775) | NOT TESTED | |
| 10 | " | 1900(1040) | 1725(940) | 1425(775) | NOT TESTED | |
| J | " | 1800(980) | None | 1325(720) | NOT TESTED | |
| 11 | " | 1800(980) | 1725(940) | 1325(720) | NOT TESTED | |
| K | Ring #4 | 1900(1040) | None | 1425(775) | 121.1(835.0) | 162.6(1121.1) |
| | | | | | 125.9(868.0) | 169.9(1171.4) |
| 12 | " | 1900(1040) | 1725(940) | 1425(775) | NOT TESTED | |
| L | " | 1800(980) | None | 1325(720) | NOT TESTED | |
| 13 | " | 1800(980) | 1725(940) | 1325(720) | NOT TESTED | |

| Ex. | R.T. Tensile % El. | % R.A. | 1200 F. (650 C.) Tensile ksi (MPa) 0.2% Y.S. | U.T.S. | % El. | % R.A. |
|---|---|---|---|---|---|---|
| A | 13.9 | 20.9 | 102.3(705.3) | 135.5(934.2) | 12.5 | 28.5 |
| | 14.7 | 20.9 | 103.4(712.9) | 135.7(935.6) | 14.3 | 33.3 |
| 1 | 14.3 | 22.7 | 97.2(670.17) | 130.2(897.0) | 11.2 | 21.3 |
| | 14.4 | 21.8 | 98.4(678.4) | 132.5(913.6) | 11.8 | 20.4 |
| B | 15.7 | 39.3 | 126.7(873.6) | 150.5(1037.7) | 19.6 | 57.9 |
| | 12.6 | 32.4 | 128.1(883.2) | 150.3(1036.3) | 19.1 | 57.0 |
| 2 | 14.4 | 33.7 | 125.8(867.4) | 144.8(998.4) | 21.7 | 64.9 |
| | 15.4 | 35.3 | 126.3(870.8) | 145.9(1005.9) | 21.5 | 61.7 |
| 3 | 13.3 | 38.1 | 124.7(859.8) | 147.9(1019.7) | 20.6 | 58.3 |
| | 15.0 | 38.3 | 128.1(883.2) | 149.8(1032.8) | 20.0 | 58.9 |
| C | 16 | 21.6 | 103.0(710.2) | 141.0(972.2) | 22 | 40.2 |
| 4 | NOT TESTED | | 97.0(668.8) | 144.8(998.4) | 9.5 | 13.1 |
| | | | 99.8(688.1) | 127.3(877.7) | 10.8 | 16.7 |
| D | 12.4 | 16.6 | 103.0(710.2) | 135.0(930.8) | 12.0 | 21.0 |
| | 10.4 | 19.9 | 102.0(703.3) | 134.0(923.9) | 13.0 | 20.0 |
| 5 | 10.4 | 15.9 | 105.8(729.5) | 130.1(897.0) | 8.3 | 12.3 |
| | 10.6 | 17.4 | 104.2(718.4) | 130.7(901.1) | 8.9 | 13.8 |
| E | 12.3 | 21.1 | 108.0(744.6) | 132.0(910.1) | 10.0 | 18.0 |
| | 11.9 | 19.0 | 105.0(723.9) | 132.0(910.1) | 9.5 | 20.0 |
| 6 | 6.5 | 13.8 | 105.5(727.4) | 134.6(928.0) | 13.2 | 28.7 |
| | 6.9 | 13.2 | 98.2(677.1) | 130.8(901.8) | 9.5 | 16.7 |
| F | 13 | 23.8 | 128.0(882.5) | 155.0(1068.7) | 18 | 47.7 |
| 7 | NOT TESTED | | 129.3(891.5) | 144.7(997.7) | 13.0 | 31.4 |

-continued

| | | | | | | |
|---|---|---|---|---|---|---|
| | | | — | 141.0(972.2) | 13.3 | 31.4 |
| G | 12.9 | 23.3 | 137.0(944.6) | 167.0(1151.4) | 15.0 | 33.0 |
| | 10.3 | 21.1 | 140.0(965.3) | 167.0(1151.4) | 13.5 | 35.0 |
| 8 | 12.2 | 25.2 | 131.1(903.9) | 143.8(991.5) | 10.6 | 25.2 |
| | 12.2 | 28.5 | 131.9(909.4) | 145.7(1004.6) | 11.6 | 29.3 |
| H | 8.4 | 17.3 | 141.0(972.2) | 157.0(1082.5) | 13.5 | 40.0 |
| | 9.2 | 18.6 | 136.0(937.7) | 158.0(1089.4) | 14.0 | 48.0 |
| 9 | 7.5 | 15.2 | 131.0(903.2) | 142.3(981.1) | 15.0 | 40.4 |
| | 10.3 | 19.6 | 131.9(909.4) | 145.7(1004.6) | 11.6 | 29.3 |
| I | | | NOT TESTED | | | |
| 10 | | | NOT TESTED | | | |
| J | | | NOT TESTED | | | |
| 11 | | | NOT TESTED | | | |
| K | 16.6 | 19.1 | 100.2(690.9) | 120.3(829.4) | 23.2 | 70.4 |
| | 10.4 | 14.5 | 101.2(697.7) | 116.8(805.3) | 29.2 | 73.1 |
| 12 | | | NOT TESTED | | | |
| L | | | NOT TESTED | | | |
| 13 | | | NOT TESTED | | | |

$T_S$-solution treating temperature
$T_P$-pre-aging step temperature
$T_A$-first aging step temperature
Heat Treatment: $T_S$/1h/AC + $T_P$8h/AC + $T_A$/8h/FC @ 100° F./h to 1150° F./8h/AC
*Heat Treatment: $T_P$/8h/AC + $T_S$/1h/AC + $T_A$8h/FC @ 100° F./h to 1150° F./8h/AC

TABLE IV

| | | | | | 1200 F./74 ksi (650 C./510 MPa) Stress Rupt. | | |
|---|---|---|---|---|---|---|---|
| Ex. | Forging Shape | $T_S$ F.(C.) | $T_P$ F.(C.) | $T_A$ F.(C.) | Rupt. Life(h) | % El. | % R.A. |
| A | Bar | 1900(1040) | None | 1425(775) | 10.9 | Notch Break | |
| | | | | | 52.9 | 2.6 | 8.8 |
| 1 | " | 1900(1040) | 1725(940) | 1425(775) | 125.9 | 26.5 | 39.7 |
| | | | | | 113.1 | 27.2 | 52.6 |
| B | " | 1800(980) | None | 1325(720) | 181.7 | 29.7 | 59.0 |
| | | | | | 189.5 | 19.5 | 53.0 |
| 2 | " | 1800(980) | 1725(940) | 1325(720) | 145.8 | 28.0 | 68.6 |
| | | | | | 194.7 | 29.5 | 67.0 |
| 3 | " | 1800*(980) | 1725*(940) | 1325(720) | 191.3 | 30.0 | 68.7 |
| | | | | | 232.0 | 26.9 | 67.0 |
| C | Ring #1 | 1900(1040) | None | 1425(775) | 6.1 | Notch Break | |
| | | | | | 15.2 | Notch Break | |
| 4 | " | 1900(1040) | 1725(940) | 1425(775) | 105.8 | 2.9 | 10.0 |
| | | | | | 70.6 | Notch Break | |
| D | Ring #2 | 1900(1040) | None | 1425(775) | 72.0 | 4.5 | 13.4 |
| | | | | | 12.6 | Notch Break | |
| 5 | " | 1900(1040) | 1725(940) | 1425(775) | 119.1 | 5.9 | 6.8 |
| | | | | | 63.7 | 7.2 | 10.8 |
| E | Pancake | 1900(1040) | None | 1425(775) | 187.3 | 9.6 | 28.9 |
| | | | | | 194.2 | 4.8 | 12.1 |
| 6 | " | 1900(1040) | 1725(940) | 1425(775) | 150.3 | 4.3 | 10.0 |
| | | | | | 138.5 | 3.5 | 6.8 |
| F | Ring #1 | 1800(980) | None | 1325(720) | 1.1 | Notch Break | |
| | | | | | 1.1 | Notch Break | |
| 7 | " | 1800(980) | 1725(940) | 1325(720) | 184.0 | 8.6 | 15.2 |
| | | | | | 153.5 | 4.8 | 6.8 |
| G | Ring #2 | 1800(980) | None | 1325(720) | 49.1 | 1.9 | 2.4 |
| | | | | | 35.3 | Notch Break | |
| 8 | " | 1800(980) | 1725(940) | 1325(720) | 5.3 | Notch Break. | |
| | | | | | 9.3 | Notch Break | |
| H | Pancake | 1800(980) | None | 1325(720) | 65.9 | Notch Break | |
| | | | | | 270.9 | 3.0 | 8.8 |
| 9 | " | 1800(980) | 1725(940) | 1325(720) | 196.5 | 9.6 | 15.2 |
| | | | | | 209.0 | 16.0 | 22.1 |
| I | Ring #3 | 1900(1040) | None | 1425(775) | 122.37 | 21.91 | 41.09 |
| | | | | | 2.03 | Notch Break | |
| 10 | " | 1900(1040) | 1725(940) | 1425(775) | 83.10 | 14.89 | 29.38 |
| | | | | | 86.30 | 14.04 | 21.65 |
| J | " | 1800(980) | None | 1325(720) | 360.03 | 30.20 | 56.30 |
| | | | | | 386.63 | 30.34 | 63.39 |
| 11 | " | 1800(980) | 1725(940) | 1325(720) | 143.92 | 33.15 | 66.70 |
| | | | | | 138.35 | 32.30 | 59.92 |
| K | Ring #4 | 1900(1040) | None | 1425(775) | 99.18 | 35.11 | 70.47 |
| | | | | | 111.30 | 14.04 | 17.63 |
| 12 | " | 1900(1040) | 1725(940) | 1425(775) | 63.73 | 19.66 | 26.53 |
| | | | | | 72.27 | 38.06 | 69.86 |
| L | " | 1800(980) | None | 1325(720) | 158.20 | 40.31 | 67.35 |
| | | | | | 162.62 | 37.22 | 61.33 |
| 13 | " | 1800(980) | 1725(940) | 1325(720) | 160.97 | 37.08 | 59.92 |

TABLE IV-continued

| Ex. | Forging Shape | $T_S$ F.(C.) | $T_P$ F.(C.) | $T_A$ F.(C.) | 1200 F./74 ksi (650 C./510 MPa) Stress Rupt. Rupt. Life(h) | % El. | % R.A. |
|---|---|---|---|---|---|---|---|
| | | | | | 147.72 | 37.50 | 70.47 |

$T_S$-solution treating temperature
$T_P$-pre-aging step temperature
$T_A$-first aging step temperature
Heat Treatment: $T_S$/1h/AC + $T_P$/8h/AC + $T_A$/8h/FC @ 100° F./h to 1150° F./8h/AC
*Heat Treatment: $T_P$8h/AC + $T_S$/1h/AC + $T_A$/8h/FC @ 100° F./h to 1150° F./8h/AC The results tabulated in Tables III and IY demonstrate the outstanding utility of the present invention as a remedial heat treatment which increases the stress rupture ductility and/or stress rupture life of the alloy from less than the minimum required level after primary heat treatment to at least the minimum required level without adversely affecting tensile strength to any significant degree. Thus, upon heat treatment according to the present invention, Examples 1 (from the laboratory forged pilot bar), 5 (from Ring No. 2), 7 (from Ring No. 1), 9 (from the upset pancake), and 10 (from Ring No. 3) demonstrate outstanding improvements in stress rupture ductility and/or stress rupture life as compared to identical samples (Exs. A, D, F, H, and I respectively) which were heat treated without the pre-aging step. Example 3 demonstrates that, when the solution treating temperature is held at or below about 1850F. (about 1010C.), preferably at about 1800F. (about 980C.) as in this example, the pre-aging step may precede solution treatment thus reversing the usual order in which the two steps are applied. Also, it is noteworthy that the present invention does not adversely affect either room or elevated temperature tensile properties to any significant degree.

The terms and expressions which have been employed are used as terms of description and not of limitation, and there is no intention in the use of such terms and expressions of excluding any equivalents of the features shown and described, or portions thereof, but it is recognized that various modifications are possible within the scope of the invention claimed.

What is claimed is:

1. In a process for improving the stress rupture life and/or the stress rupture ductility of a precipitation or age hardenable alloy when in the aged condition, said alloy containing nickel, niobium, and silicon for forming a (Ni, Nb, Si)-containing intermetallic phase, said alloy having less than a predetermined level of stress rupture life and/or stress rupture ductility when worked and aged by a primary heat treatment, the step of pre-aging said alloy at a temperature and for a time sufficient to form said (Ni, Nb, Si)-containing intermetallic phase in a quantity sufficient to improve the stress rupture life and/or stress rupture ductility of said alloy to at least said predetermined level when aged.

2. A process as recited in claim 1 wherein said pre-aging step is carried out at a temperature and for a time sufficient to form at least 0.25 volume percent of said (Ni, Nb, Si)-containing intermetallic phase.

3. A process for improving the stress rupture life and/or the stress rupture ductility of a precipitation or age hardenable alloy containing nickel, niobium, and silicon for forming a (Ni, Nb, Si)-containing intermetallic phase, said alloy having less than a predetermined level of stress rupture life and/or stress rupture ductility when worked and aged by a primary heat treatment: said process comprising the steps of:

(a) solution treating said alloy at a temperature and for a time sufficient to dissolve the major portion of precipitated intermetallic phases present in said alloy;

(b) pre-aging said alloy at a temperature and for a time sufficient too form said (Ni, Nb, Si)-containing intermetallic phase in a quantity sufficient to improve the stress rupture life and/or stress rupture ductility of said alloy to at least said predetermined level when aged; and then (c) aging said alloy at a temperature and for a time sufficient to form a strengthening phase in said alloy;

wherein step (a) may be performed before or after step (b).

4. A process for improving the stress rupture life and/or stress rupture ductility of a precipitation or age hardenable alloy containing, in weight percent, about

| | w/o |
|---|---|
| Silicon | from a small but effective amount to about 1 |
| Nickel | 25-65 |
| Niobium | 1.5-7 |

for forming a (Ni, Nb, Si)-containing intermetallic phase, said alloy having less than a predetermined level of stress rupture life and/or stress rupture ductility when worked and aged by a primary heat treatment; said process comprising the steps of:

(a) solution treating said alloy at a temperature and for a time sufficient to dissolve the major portion of precipitated intermetallic phases present in said alloy;

(b) pre-aging said alloy at a temperature and for a time sufficient to form said (Ni, Nb, Si)-containing intermetallic phase in a quantity sufficient to improve the stress rupture life and/or stress rupture ductility of said alloy to at least said predetermined level when aged; and then (c) aging said alloy at a temperature and for a time sufficient to form a strengthening phase in said alloy;

wherein step (a) may be performed before or after step (b).

5. A process for improving the stress rupture life and/or stress rupture ductility of a precipitation or age hardenable alloy consisting essentially of, in weight percent, about

| | w/o |
|---|---|
| C | 0–0.1 |
| Mn | 0–2 |
| Si | from at least a small but effective amount to about 1 |
| Cr | 0–25 |
| Mo | 0–10 |
| Ni | 25–65 |
| Co | 0–25 |
| Ti | 0.5–4 |
| Nb | 1.5–7 |
| Al | 0–2 |
| V | 0–1 |
| B | 0–0.03 |
| Zr | 0–0.1 |
| Hf | 0–2 |
| W | 0–3 |

the balance essentially iron, said alloy containing said nickel, niobium and silicon for forming a (Ni, Nb, Si)-containing intermetallic phase, said alloy having less than a predetermined level of stress rupture life and/or stress rupture ductility when worked and aged by a primary heat treatment; said process comprising the steps of:

(a) solution treating said alloy at a temperature and for a time sufficient to dissolve the major portion of precipitated intermetallic phases present in said alloy;

(b) pre-aging said alloy at a temperature and for a time sufficient to form said (Ni, Nb, Si)-containing intermetallic phase in a quantity sufficient to improve the stress rupture life and/or stress rupture ductility of said alloy to at least said predetermined level when aged; and then (c) aging said alloy at a temperature and for a time sufficient to form a strengthening phase in said alloy;

wherein step (a) may be performed before or after step (b).

6. A process as recited in claim 5 wherein said alloy contains, in weight percent, about

| | w/o |
|---|---|
| Mn | 1 max. |
| Cr | 1 max. |
| Mo | 1 max. |
| Ni | 55 max. |
| Ti | 1–3 |
| V | 0.5 max. |
| W | 0.5 max. |

7. A process as recited in claim 6 wherein said alloy contains, in weight percent, about

| | w/o |
|---|---|
| Mn | 0.5 max. |
| Cr | 0.5 max. |
| Mo | 0.5 max. |
| Ni | 45 max. |
| Co | 5–20 |
| Ti | 1–2.5 |
| Nb | 3–7 |
| Al | 0.2 max. |
| B | 0.02 max. |
| Zr | 0.01 max. |
| Hf | 0.1 max. |

8. A process as recited in claim 7 wherein said alloy contains about 32–45% Ni.

9. A process as recited in claim 7 wherein said alloy contains about 0.1–0.7% Si.

10. A process as recited in claim 7/wherein said alloy contains about 10–20% Co.

11. A process as recited in claim 8 wherein said alloy contains about 32–40% Ni.

12. A process as recited in claim 9 wherein said alloy contains about 0.2–0.7% Si.

13. A process as recited in claim 7 wherein said alloy contains about

| | w/o |
|---|---|
| Si | 0.2–0.7 |
| Ni | 32–40 |
| Co | 10–20 |

14. A process as recited in claim 3 wherein said alloy is solution treated at a temperature and for a time such that solutioning of any (Ni, Nb, Si)-containing intermetallic phase present in said alloy is minimized.

15. A process as recited in claim 3 wherein said alloy is solution treated at a temperature and for a time sufficient to dissolve substantially all precipitated intermetallic phases present in said alloy.

16. A process as recited in claim 15/wherein said alloy is solution treated at a temperature and for a time such that solutioning of any (Ni, Nb, Si)-containing intermetallic phase present in said alloy is minimized.

17. A process as recited in claim wherein the solution treating step is carried out in the temperature range of about 1500–2100F. (about 815–1150C.).

18. A process as recited in claim 13 wherein the solution treating step is carried out at about 1800–2000F. (about 980–1095C).

19. A process as recited in claim 13 wherein the solution treating step is carried out at about 1800–1900F. (about 980–1040C.).

20. A process as recited in claim 3 wherein said pre-aging step is carried out at a temperature and for a time sufficient to form at least 0.25 volume percent of said (Ni, Nb, Si)-containing intermetallic phase.

21. A process as recited in claim 5 wherein said pre-aging step is carried out at about 1500–1900F. (about 815–1040C).

22. A process as recited in claim 13 wherein said pre-aging step is carried out at about 1675–1850F. (about 915–1010C.).

23. A process as recited in claim 1 wherein said pre-aging step is carried out at about 675–1750F. (about 915–955C.).

24. A process as recited in claim 3 wherein said solution treating step is carried out before said pre-aging step.

25. A process as recited in claim 3 wherein said pre-aging step is carried out before said solution treating step, said solution treating step being carried out at a temperature and for a time such that at least 0.25 volume percent of said (Ni, Nb, Si)-containing intermetallic phase remains undissolved after said solution treating step is completed.

26. A process as recited in claim 13 wherein said pre-aging step is carried out before said solution treating step, and said solution treating step is carried out at or below about 1850F. (about 1010C.).

27. A process as recited in claim 5 wherein the aging step further comprises the steps of (a) heating said alloy at about 1200–1500F. about 650–815C.) for a time sufficient to precipitate a strengthening phase within said alloy; then (b) cooling said alloy to about 1100–1200F. (about 595–650C.); and then (c) maintaining said alloy at about 1100–1200F. (about 595–650C.) for a time sufficient to further precipitate said strengthening phase within said alloy.

28. A process as recited in claim 27 wherein the temperature in step (a) is maintained for at least 4–12 h.

29. A process as recited in claim 27 wherein the temperature in step (a) is reduced, by controlled cooling of said alloy at a rate of about 100F.° /h (about 56C° /h), to the temperature in step (c) and then wherein said temperature in step (c) is maintained for at least 4 h.

30. A process as recited in claim 13 wherein the aging step further comprises the steps of (a) heating said alloy at about 1275–1475F. (about 690–800C.) for a time sufficient to precipitate a strengthening phase within said alloy; then (b) cooling said alloy to about 1100–1200F. (about 595–650C.); and then (c) maintaining said alloy at about 1100–1200F. (about 595–650C.) for a time sufficient to further precipitate said strengthening phase within said alloy.

31. A process as recited in claim 30 wherein the temperature in step (a) is maintained for at least 4–12 h.

32. A process as recited in claim 30 wherein the temperature in step (a) is reduced, by controlled cooling of said alloy at a rate of about 100F.° /h (about 56C° /h), to the temperature in step (c) and then wherein said temperature in step (c) is maintained for at least 4h.

33. A precipitation hardened article, heat treated by the process recited in claim 1.

34. A precipitation hardened article, heat treated by a process for improving the stress rupture life and/or the stress rupture ductility of a precipitation or age hardenable alloy when in the aged condition, said alloy consisting essentially of, in weight percent, about

| | w/o |
|---|---|
| C | 0–0.1 |
| Mn | 0–0.5 |
| Si | 0.2–0.7 |
| Cr | 0–0.5 |
| Mo | 0–0.5 |
| Ni | 32–40 |
| Co | 10–20 |
| Ti | 1–2.5 |
| Nb | 3–7 |
| Al | 0–0.2 |
| V | 0–0.5 |
| B | 0–0.02 |
| Zr | 0–0.01 |
| Hf | 0–0.1 |
| W | 0–0.5 |

the balance essentially iron, said article containing a (Ni, Nb, Si)-containing intermetallic phase, said article having less than a predetermined level of stress rupture life and/or stress rupture ductility when worked and aged by a primary heat treatment, said process including the step of pre-aging said alloy at a temperature and for a time sufficient to form said (Ni, Nb, Si)-containing intermetallic phase in a quantity sufficient to improve the stress rupture life and/or stress rupture ductility of said alloy to at least said predetermined level when aged.

35. A precipitation hardened article, heat treated by the process recited in claim 3.

36. An article as recited in claim 34 wherein said alloy consists essentially of, in weight percent, about

| | w/o |
|---|---|
| C | 0–0.1 |
| Mn | 0–0.5 |
| Si | 0.2–0.7 |
| Cr | 0–0.5 |
| Mo | 0–0.5 |
| Ni | 32–40 |
| Co | 10–20 |
| Ti | 1–2.5 |
| Nb | 3–7 |
| Al | 0–0.2 |
| V | 0–0.5 |
| B | 0–0.02 |
| Zr | 0–0.01 |
| Hr | 0–0.1 |
| W | 0–0.5 |

said process comprising the steps of:

(a) solution treating said alloy at a temperature and for a time sufficient to dissolve the major portion of precipitated intermetallic phases present in said alloy;

(b) pre-aging said alloy at a temperature and for a time sufficient to form said (Ni, Nb, Si)-containing intermetallic phase in a quantity sufficient to improve the stress rupture life and/or stress rupture ductility of said alloy to at least said predetermined level when aged; and then (c) aging said alloy at a temperature and for a time sufficient to form a strengthening phase in said alloy;

wherein step (a) may be performed before or after step (b).

37. A precipitation hardened article, formed of an austenitic alloy containing nickel, niobium, and silicon, said article containing a (Ni, Nb, Si)-containing intermetallic phase; said article being comprised of at least 0.25 volume percent of particles of said intermetallic phase said particles being substantially uniformly dispersed throughout the austenitic matrix and being globular inn shape and having a major diameter of about 0.1–2 μm.

38. An article as recited in claim 37 wherein said intermetallic phase particles are distributed along grain boundaries and are substantially uniformly dispersed throughout the alloy matrix.

39. A precipitation hardened article, formed of an austenitic alloy, said alloy consisting essentially of, in weight percent, about

| | w/o |
|---|---|
| C | 0–0.1 |
| Mn | 0–0.5 |
| Si | 0.2–0.7 |
| Cr | 0–0.5 |
| Mo | 0–0.5 |
| Ni | 32–40 |
| Co | 10–20 |
| Ti | 1–2.5 |
| Nb | 3–7 |
| Al | 0–0.2 |
| V | 0–0.5 |
| B | 0–0.02 |
| Zr | 0–0.01 |
| Hf | 0–0.1 |

-continued

| | w/o |
|---|---|
| W | 0–0.5 |

and the balance essentially iron, said article containing a (Ni, Nb, Si)-containing intermetallic phase; said article being comprised of at least 0.25 volume percent of particles of said intermetallic phase, said particles being substantially uniformly dispersed throughout the austenitic matrix and being globular in shape and having a major diameter of about 0.1–2 $\mu$m.

40. An article as recited in claim 39 wherein said intermetallic phase particles are distributed along grain boundaries and are substantially uniformly dispersed throughout the alloy matrix.

41. A process as recited in claim 1 wherein said alloy contains, in weight percent, about

| | w/o |
|---|---|
| Silicon | from a small but effective amount to about 1 |
| Nickel | 25–65 |
| Niobium | 1.5–7 |

* * * * *

UNITED STATES PATENT AND TRADEMARK OFFICE

CERTIFICATE OF CORRECTION

PATENT NO. : 5,059,257

DATED : October 22, 1991

INVENTOR(S) : EDWARD A. WANNER and SUNIL WIDGE

It is certified that error appears in the above-identified patent and that said Letters Patent is hereby corrected as shown below:

Column 1:

Line 8: delete "nickel and nickel-iron base":

Line 10: after "such" insert --nickel and nickel-iron base--.

Column 3:

Line 9: "D.F." should be --J.S.--;

Line 18: "1459" should be --'459--;

Line 41: delete "nickel and nickel-iron base";

Line 51: delete "nickel and nickel-iron base".

Column 4:

Line 29: delete "nickel and nickel-iron base".

Column 5:

Line 12: after "0-0.5", first occurrence, "Y" should be --V--;

Line 31: "v" should be --V--.

Column 6:

Line 20: "on" should be --On--.

Column 9:

Line 62: "IY" should be --IV--;

Line 66: "IY" should be --IV--;

Line 67: "7-7/8" should be --7-3/8-- and "2-$\beta$ " should be --2-7/8--.

UNITED STATES PATENT AND TRADEMARK OFFICE

CERTIFICATE OF CORRECTION

PATENT NO. : 5,059,257

DATED : October 22, 1991

INVENTOR(S) : EDWARD A. WANNER and SUNIL WIDGE

It is certified that error appears in the above-identified patent and that said Letters Patent is hereby corrected as shown below:

Column 10:

Lines 1, 6, and 9: at each occurrence, "IY" should be --IV--;

Line 3: "Iv" should be --IV--;

Line 59: "Iv" should be --IV--.

Column 12:

Line 4: "Iv" should be --IV--.

After line 10 and before the table: insert the heading --TABLE III--;

In the table column headed "R.T. Tensile ksi (MPa)" under "0.2% Y.S.", line 18: "(937.17) should be --(937.7)--.

Column 13: Lines 20 and 21:

In the footnotes to TABLE III: in the fourth footnote after "$T_s$/1h/AC+", "$T_p$8h/AC" should be --$T_p$/8h/AC--:

In the fifth footnote after "$T_s$/1h/AC +", "$T_A$8h/FC" should be --$T_A$/8h/FC--.".

Column 15: Line 12;

In the footnotes to TABLE IV: in the last footnote after "Heat Treatment:", "$T_p$8h/AC" should be --$T_p$/8h/AC--.

Line 14: "IY" should be --IV--.

Column 18:

Line 5: "7/" should be --7--;

Line 28: "15/" should be --15--;

Line 32: after "claim" insert --5--;

Line 52: change "1" to --13--.

UNITED STATES PATENT AND TRADEMARK OFFICE

CERTIFICATE OF CORRECTION

PATENT NO. : 5,059,257

DATED : October 22, 1991

INVENTOR(S) : EDWARD A. WANNER and SUNIL WIDGE

It is certified that error appears in the above-identified patent and that said Letters Patent is hereby corrected as shown below:

Column 18, continued:

Line 53: "675" should be --1675--.

Column 19:

Line 3: before "about" (2nd occurrence) insert --(--.

Column 20:

Line 46: after "globular", "inn" should be --in--.

Signed and Sealed this

Fourth Day of May, 1993

*Attest:*

Michael K. Kirk

MICHAEL K. KIRK

*Attesting Officer*

*Acting Commissioner of Patents and Trademarks*